United States Patent [19]

Hartwig, Sr.

[11] Patent Number: 4,959,928

[45] Date of Patent: Oct. 2, 1990

[54] AIR-ASSISTED BUFFING PAD CLEANING TOOL AND ASSOCIATED CLEANING METHODS

[76] Inventor: Carl C. Hartwig, Sr., P.O. Box 734, Princeton, Tex. 75077

[21] Appl. No.: 420,529

[22] Filed: Oct. 12, 1989

[51] Int. Cl.[5] ..... B24B 53/00

[52] U.S. Cl. ..... 51/262 A

[58] Field of Search ..... 51/262 A

[56] References Cited

U.S. PATENT DOCUMENTS

| | | | |
|---|---|---|---|
| 1,022,701 | 4/1912 | Rogers | 51/262 A |
| 1,279,219 | 9/1918 | Baird | 51/262 A |
| 2,619,009 | 11/1952 | Begle | 51/262 A |
| 3,596,413 | 8/1971 | Stewart | 51/262 A |
| 4,438,601 | 3/1984 | Olsen | 51/262 A |
| 4,525,955 | 7/1985 | Cothrell | 51/262 A |
| 4,528,743 | 7/1985 | Bleich | 51/262 A |

FOREIGN PATENT DOCUMENTS

| | | | |
|---|---|---|---|
| 243241 | 8/1960 | Australia | 51/262 A |
| 495133 | 8/1953 | Canada | 51/262 A |

*Primary Examiner*—Frederick R. Schmidt
*Assistant Examiner*—Blynn Shideler
*Attorney, Agent, or Firm*—Hubbard, Thurman, Turner, Tucker & Harris

[57] ABSTRACT

An air-assisted tool for mechanically cleaning a rotary driveable buffing pad or the like comprises a hollow body portion to which a series of mutually spaced, externally toothed cleaning spurs are rotatably secured. The tool has an air inlet fitting connectable to a high pressure air supply hose to flow pressurized air through the tool body, and an outlet passage for discharging the air at a point adjacent the spur members. To use the tool, an operator grasps the tool body, places the cleaning spurs on the buffing pad during driven rotation thereof, and laterally moves the spurs radially inwardly and outwardly along the operative side of the rotating pad. The spurs are rapidly rotated by the moving pad and function to circumferentially rake the rotating pad to dislodge therefrom hardened cleaning material or the like adhering thereto from a previous use of the pad. The hardened material dislodgement action of the spurs is augmented by the discharged high pressure air continuously striking the pad area being raked and functioning to dislodge hardened material which might otherwise still adhere to the rotating pad.

7 Claims, 2 Drawing Sheets

AIR-ASSISTED BUFFING PAD CLEANING TOOL AND ASSOCIATED CLEANING METHODS

BACKGROUND OF THE INVENTION

The present invention relates generally to cleaning apparatus and, in preferred embodiments thereof, more particularly provides air-assisted apparatus for use in cleaning rotary buffing pads or the like used, for example, in cleaning and polishing the painted exterior surfaces of cars and trucks.

When the previously shiny exterior painted surface of a car or truck begins to dull due to "deadening" of its paint pigment after extended exposure to harsh sunlight, dirt, dust, grime and the like, the paint finish is often "restored" using a suitable rubbing compound applied to the dulled paint surface with a motor-driven rotary buffing pad. Rotary buffing pads of this general type are usually formed from a relatively thick pile material such as wool, and are also used in the final buffing and polishing step in an automotive vehicle wax job, or in other applications such as polishing wood, marble and other surfaces.

As is well known, the rubbing compound, wax, or other liquid or paste-like materials applied with the typical rotary buffing pad tend to cake and harden within the fibers of the pad on its operative side, between uses thereof. If the buffing pad is not thoroughly cleaned before its next use, these hardened,quite abrasive materials imbedded in the pad can easily damage the finish of the next surface upon which the pad is used. For example, if an uncleaned buffing pad previously used to apply rubbing compound to a first vehicle is later used on the painted surface of a second vehicle, the caked-on, hardened rubbing compound and removed paint pigment can easily wear or "burn" through the finish of the second vehicle.

The requisite cleaning of rotary buffing pads between successive uses thereof is conventionally achieved by simply sending the used pad to a commercial cleaning service which, using a suitable solvent, removes the caked-on, abrasive material and returns the cleaned buffing pad to the owner. While this fluid cleaning process is normally quite effective in returning the buffing pads in a clean and usable condition, the used cleaning pads are typically out of service for a significant amount of time, and this commercial cleaning service is usually relatively expensive.

Another method of cleaning used buffing pads, which is considerably quicker and may be carried out by the user of the pad, entails the use of a mechanical cleaning device which comprises a handle portion to which a spaced series of annular, spur-shaped cleaning members are rotatably secured. With the used buffing pad being rotationally driven, lower edge portions of these spur members are positioned against the operative side surface of the rotating pad and are laterally moved back and forth in a generally radial direction relative to the rotating pad. The spur members are rotated by the rotating pad, and the outer teeth portions of the spur members operate to separate and disrupt the pile portions of the pad which they rollingly contact and circumferentially rake, the theory being that this separation and disruption of adjacent pile portions in the rotating pad will dislodge the hardened, abrasive material adhering thereto and cause it to be discharged from the pad.

While this mechanical do-it-yourself approach to buffing pad cleaning is certainly more convenient, and less expensive, than sending the used pads to a commercial cleaning service, it has proven to be significantly less thorough and effective in cleaning the used pads. While a significant amount of pad cleaning is mechanically achieved, a substantial portion of the hardened cleaning material or the like typically remains imbedded in and matted on the fibers of the pad.

From the foregoing it can be seen that it would be quite desirable to provide an improved mechanical apparatus, and associated methods, for cleaning rotary buffing pads and the like which more effectively cleans the pads. It is accordingly an object of the present invention to provide such improved mechanical apparatus and associated pad cleaning methods.

SUMMARY OF THE INVENTION

In carrying out principles of the present invention, in accordance with preferred embodiments thereof, a portable, hand-operable cleaning tool is provided for mechanically dislodging and removing potentially abrasive material, such as a hardened rubbing compound material or the like, adhered to the operative side of a previously used rotary buffing pad. The tool basically comprises a body portion adapted to be grasped and moved by an operator, and a spaced, coaxial plurality of generally circular, peripherially toothed cleaning spur members rotatably secured to the body portion.

During driven rotation of the used buffing pad, the tool is used by grasping its body portion and pressing the cleaning spur members against the operative side of the rotating pad and moving the tool body portion in a manner laterally moving the cleaning spur members generally radially inwardly and outwardly along the rotating pad. This inward and outward lateral movement of the cleaning spurs causes them to circumferentially rake the rotating pad while being rolled thereby, along varying radial locations thereon, to dislodge hardened material adhered thereto.

To significantly augment the hardened material dislodgement action of the cleaning spur members, air assist means are carried by the tool body portion for movement therewith, and are operative to receive compressed air from a source thereof, and discharge the received air in a manner causing it to forcibly impinge upon the rotating pad generally at the location thereon being circumferentially raked by the rolling cleaning spur members. The impinging pressurized air functions to dislodge and blow away portions of the hardened material on the pad which might otherwise not be removed therefrom by the cleaning spur members. The air-assisted mechanical pad cleaning action of the rolling spur members is further enhanced by residual moisture in the compressed air which tends to soften the rotating pad.

The raking action of the rolling spurs, coupled with the impingement on the pad of the discharged air, functions to thoroughly and relatively rapidly clean the used buffing pad to prepare it for a subsequent use without the delay and expense typically associated with sending the used pad to a commercial cleaning service which utilizes a fluid-based cleaning process. The mechanical buffing pad cleaning tool of the present invention is relatively inexpensive to fabricate, is light weight and easy to use, and provides for the substantially improved mechanical cleaning of rotary buffing pads.

In one embodiment of the tool, its body portion is defined by a conventional air blow gun of the type having a hollow body comprising a handle portion which extends downwardly from the inner end of an elongated barrel portion having an internally threaded outer end to which a discharge nozzle is threadingly secured. At the bottom end of the handle portion is an air inlet fitting to which a high pressure air supply hose may be connected to flow compressed air into the hollow gun handle. Adjacent the juncture of the handle and barrel portions of the gun, a trigger mechanism is pivotally secured and is operative to actuate an internal valve mechanism within the gun to selectively flow pressurized air from within its handle portion through the gun barrel and outwardly through its discharge nozzle (which is removed prior to assembling the tool of the present invention).

To rotatably mount the previously mentioned cleaning spur members on the conventional air blow gun, a support yoke member is provided which comprises a yoke base portion from whose opposite ends a spaced pair of yoke arms extend in the same direction. The cleaning spur members are rotatably supported, in a longitudinally spaced, coaxial array, between outer end portions of the yoke arms. Extending outwardly from the yoke base portion, in a direction opposite from that of the yoke arms, is an externally threaded boss member which is screwed into the gun barrel discharge end portion, the boss member being rotationally locked to the outer gun barrel end portion by means of a small roll pin or the like extended radially inwardly through the outer gun barrel end portion into an exterior side portion of the inserted boss member.

A circular opening is formed transversely through the yoke base portion, and generally axially through the boss member, and an end portion of a small air delivery tube is press-fitted into such opening toward the gun barrel. The remaining portion of the tube is positioned generally between the yoke arms, and is bent downwardly so that the outer or discharge end of the tube is positioned adjacent, and directed generally toward, lower peripheral edge portions of the cleaning spurs.

With a high pressure air delivery hose operatively connected to the gun's inlet fitting, the tool is used by simply grasping the gun handle and moving it back and forth to laterally move the yoke-supported cleaning spurs generally radially inwardly and outwardly along the operative side of the rotating, previously used buffing pad while depressing the gun's trigger lever. Pressurized air within the hollow gun body is discharged from the air delivery tube and forcibly impinges upon the rotating pad, generally at the area thereon being circumferentially raked by the rolling cleaning spur members.

In an alternate embodiment of the cleaning tool, the tool body portion is defined by an elongated metal tube having an externally threaded first end portion, and a second end portion to which an air inlet fitting and an air shut-off valve are operatively secured. A cap member is threaded onto the first end of the tube, and the cleaning spur members are rotatably mounted and captively retained on the tube adjacent its end cap for coaxial rotation about the tube axis. The individual cleaning spur members are axially spaced apart by interposed spacing collars that circumscribe the tube. A longitudinally central one of the spacing collars is rotationally locked on the tube, and an air discharge opening is extended outwardly through the tube, and radially outwardly through the rotationally locked spacing collar, between an adjacent pair of the rotationally mounted cleaning spur members.

DETAILED DESCRIPTION

Figure 1:
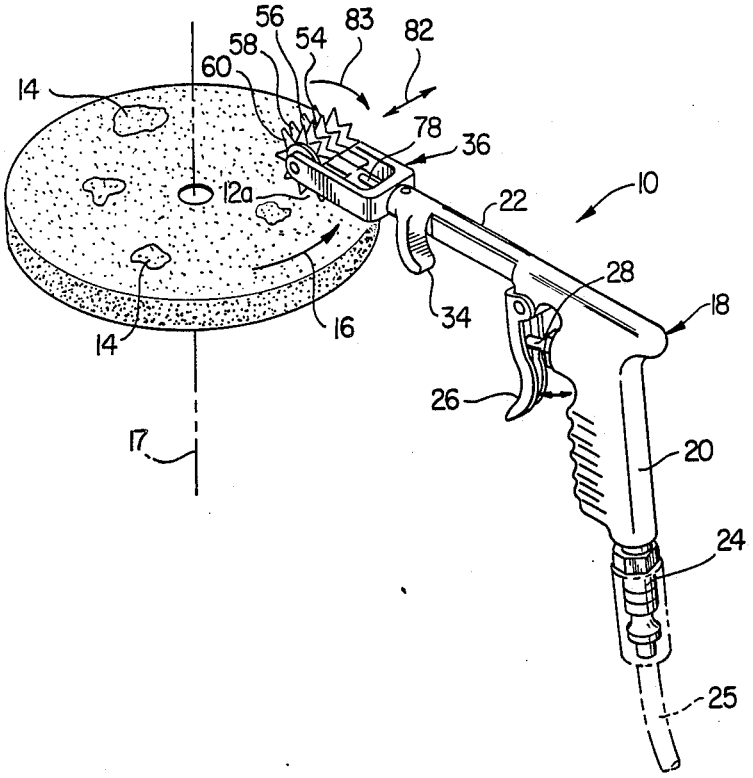
FIG. 1 is a perspective view illustrating the operation of an air-assisted mechanical buffing pad cleaning tool which embodies principles of the present invention.
Figures 2, 4, 5:
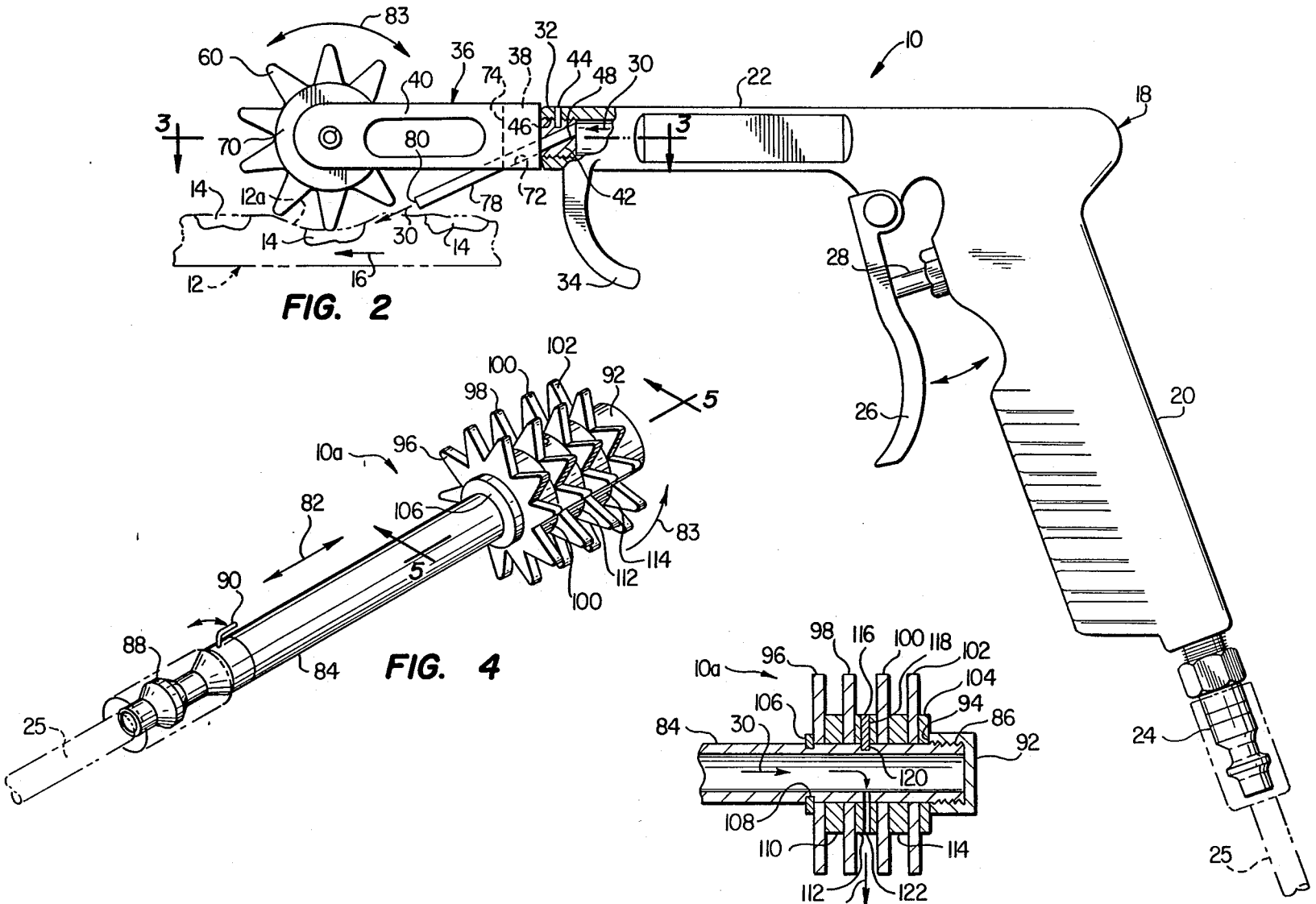
FIG. 2 is an enlarged scale side elevational view of the tool.
FIG. 4 is a perspective view of an alternate embodiment of the tool.
FIG. 5 is an enlarged scale partial cross-sectional view through the alternate tool embodiment taken along Line 5-5 of FIG. 4.

Referring initially to FIGS. 1 and 2 of the drawings, the present invention provides an air-assisted tool 10 for use in mechanically cleaning a buffing pad 12 which has imbedded in and matted on its fabric, on the operative side of the pad, hardened cleaning or polishing material 14 from a previous use of the pad. During both operative use of the pad 12 and cleaning of the pad with the specially designed tool 10, the pad 12 is rapidly rotated, as indicated by the arrow 16 in FIG. 1, about its central axis 17 by a conventional motor-driven structure (not illustrated) removably secured to the pad.

The illustrated tool 10 includes a conventional air blow gun 18 having a hollow body with a handle portion 20 and an elongated barrel portion 22. The lower end of the handle portion 0 has an inlet fitting 24 secured thereto which may be connected to a pressurized air supply hose 25 for flowing high pressure air from a source thereof into the interior of the handle portion 20. A trigger lever 26, having an associated plunger member 28 connected thereto, is pivotally secured to the barrel portion 22 and may be squeezed to move the plunger member 28 into the interior of the handle portion 20. Inward movement of the plunger member 28 in this manner causes it to open a conventional valve structure (not illustrated) disposed within the handle portion 20 to permit a flow of high pressure air 30 from within the handle portion outwardly through the internally threaded outer end 32 of the barrel portion 22. An outlet nozzle fitting normally threaded into the outer barrel end 32 is removed for purposes of constructing the tool 10. Adjacent the outer barrel end 32 a hanging hook 34 is formed on the barrel. In a conventional fashion, the trigger lever 26 is spring biased toward its solid line position indicated in FIG. 2 in which the plunger 28 maintains the internal valve structure in its closed position to prevent high pressure air flow through the interior of the body of the air blow gun 18.

Figure 3:
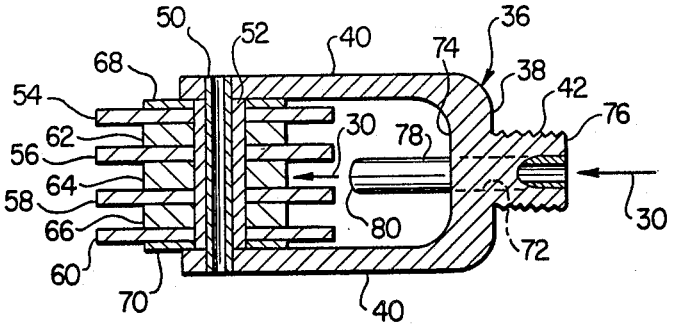
FIG. 3 is a partial cross-sectional view through the tool taken along Line 3—3 of FIG. 2.

Referring now to FIGS. 2 and 3, the tool 10 also includes a support yoke member 36 having a base portion 38, a pair of arms 40 projecting leftwardly from the opposite ends of the base portion 38, and an externally threaded solid cylindrical boss 42 projecting righwardly from a central portion of the yoke base 38. As illustrated in FIG. 2, the boss 42 is threaded into the outer end 32 of the blow gun barrel portion 22 to a position in which the yoke arms 40 are horizontally aligned with one another with the blow gun in its FIG. 2 orientation. To rotationally lock the support yoke 36 in this position, a small roll pin 44 is pressfitted downwardly through a small opening 46 formed in the outer gun end 32, and into an aligned opening 48 formed in the boss 42.

The opposite ends of a roll pin 50 are press-fitted into suitable aligned openings formed in outer end portions of the yoke arms 40. Coaxially and rotatably supported on the roll pin 50 is a support tube member 52 which extends between the opposite inner side surfaces of the yoke arms 40. Four externally toothed annular cleaning spur members 54, 56, 58 and 60 are coaxially and rotatably supported on the support tube member 52 and are axially spaced apart thereon by thick spacing washers or spacing collars 62, 64 and 66 which are also rotatably supported on the support tube member 52 between the yoke arms 40. As illustrated in FIG. 3, the washer 62 is interposed between the spurs 54 and 56, the washer 64 is interposed between the spurs 56 and 58, and the washer 66 is interposed between the spurs 58 and 60. Thin spacing washers 68 and 70 are also rotatably supported on the support tube member 52, the washer 68 being interposed between the spur 54 and its adjacent yoke arm 40, and the washer 70 being interposed between the spur 60 and its adjacent yoke arm 40.

As best illustrated in FIG. 3, the rotatably supported cleaning spurs, 54, 56, 58 and 60 are positioned leftwardly or forwardly apart from the yoke base portion 38. For purposes later described, a rightwardly and upwardly angled circular opening 72 is formed from a lower central portion of the inner side surface 74 of the yoke base 38 to the outer end 76 of the yoke boss 42. A right end portion of a small diameter, open-ended metal flow tube 78 is press-fitted into opening 72, with the balance of the tube 78 extending leftwardly and downwardly to position a discharge end 80 thereof rearwardly adjacent, and generally directed toward, bottom side edge portions of the cleaning spurs and generally centered between the central spurs 56 and 58 as illustrated in FIGS. 2 and 3.

To use the tool 10, as illustrated in FIG. 1, the previously used buffing pad 12, with the hardened and quite abrasive material 14 thereon, is drivingly rotated at high speed as indicated by the arrow 16. The gun handle portion 20 is grasped by the operator and, with the gun barrel 22 projecting outwardly from the rotating pad 12, lower side edge portions of the cleaning spurs 54, 56, 58 and 60 are positioned atop the operative side of the pad and the gun 18 is laterally moved back and forth to laterally move the cleaning spurs generally radially inwardly and outwardly along the top surface of the rotating pad as indicated by the double-ended arrow 82 in FIG. 1.

This inward and outward lateral movement of the cleaning spurs to be rearwardly rolled, in direction 83, by the rotating pad across its operative side, thereby causing the rolling spurs to circumferentially rake the pad 12 (FIG. 2) along an area $12_a$ whose location on the pad varies radially during the mechanical cleaning process. The rolling/raking action of the spurs continuously separates adjacent pile portions of the pad and operates to dislodge hardened material 14 caked thereon.

The dislodgement and removal of the hardened cleaning material 14 from the rotating pad 12 created by the raking action of the rolling cleaning spurs is very substantially improved simply by depressing the trigger lever 26 to thereby create a high velocity outflow of pressurized air 30 from the discharge end 80 of the flow tube 78 as illustrated in FIG. 2. This outflow of high pressure air 30 adjacent lower peripheral edge portions of the rotating cleaning spurs is forcibly directed generally onto the rotating pad area $12_a$ which they are continuously raking, and tends to blow away caked-on material 14 which might otherwise continue to adhere to the previously raked pad area. Residual moisture in the compressed air 30 striking pad area $12_a$ tends to soften the pad to augment the overall mechanical leaning action just described.

Coupled with the raking action of the rolling cleaning spurs, this continuously maintained discharge jet of high pressure pad impingement air permits a greatly improved and substantially more thorough mechanical cleaning of the pad in a manner permitting it to be quickly returned to use without the risk of residual, hardened material 14 damaging the finish of the item upon which the cleaned pad 12 is subsequently used. The use of the air-assisted mechanical cleaning tool 10 in this manner essentially eliminates the previous necessity of sending the used pad 12 to a commercial pad laundry service with its attendant delay and expense. The illustrated tool 10 is quite easy, and relatively inexpensive, to fabricate using the conventional air blow gun 18 to which the spur, yoke and tube subassembly may be rapidly attached.

An alternate embodiment $10_a$ of the air-assisted buffing pad cleaning tool just described is illustrated in FIGS. 4 and 5. The tool $10_a$ includes an elongated metal tube 84 having an externally threaded right end 86, and a left end to which a conventional air inlet fitting 88 and an air shut-off valve 90 are operatively secured. An internally threaded cap member 92, having an annular inner end 94, is threaded onto the tube end 86.

Coaxially and rotatably mounted on a right end portion of the tube 84 axially inwardly of cap 92, are four externally toothed annular clearing spur members 96, 98, 100 and 102 which are similar in configuration and operation to the spurs 54, 56, 58 and 60 previously described in conjunction with the tool 10 illustrated in FIGS. 1–3. These cleaning spurs are captively retained, in an axial sense, on the tube 84 between a thin washer member 104 mounted on the tube 84 and abutting the inner cap end 94, and a snap ring 106 removably received in an annular groove 108 formed in the outer periphery of the tube 84. The cleaning spurs 96, 98, 100 and 102 are axially spaced apart on the tube 84 by three thick washers or spacing collar members 110, 112 and 114 which are coaxially carried by the tube 84. As illustrated, the spacing collar 110 is interposed between the spurs 96 and 98, the spacing collar 112 is interposed between the spurs 98 and 100, and the spacing collar 114 is interposed between the spurs 100 and 102.

The central spacing collar 112 is rotationally locked on the tube 14 by means of a roll pin 116 which is press-fitted downwardly through a radial opening 118 formed through the spacing collar 112, and an aligned circular bore 120 formed in an exterior side portion of the tube 84. Diametrically opposite the roll pin 116 is a radially extending air outlet passage opening 122 formed through the tube 84 and exiting outwardly through the spacing collar 112 to its outer side surface.

To use the tool $10_a$, the previously described pressurized air supply hose 25 is secured to the air inlet fitting 88, and a portion of the tube 84 between the cleaning spurs 96, 98, 100 and 102 and the air shut-off valve 90 is grasped by the operator. Lower peripheral edge portions of the cleaning spurs adjacent the air outlet passage 122 are positioned atop the rapidly rotating buffing pad 12, and the spurs are laterally moved radially inwardly and outwardly along the rotating pad, as indicated by the double-ended arrow 82 in FIG. 4, to cause the spurs to be rearwardly rolled in direction 83 by the rotating pad.

This causes the rolling spurs 96, 98, 100 and 102 to circumferentially rake the rotating pad as previously described in conjunction with FIG. 2. With the shut-off valve 90 moved to its open position depicted in FIG. 4, pressurized air 30 is flowed rightwardly through the tube 84 and is radially discharged therefrom via the air outlet passage 122 as illustrated in FIG. 5. The high pressure air 30 downwardly discharged from the air outlet passage 122 forcibly impinges directly upon the pad area being raked, and functions to supplement the raking action of the cleaning spurs to provide a very rapid and quite thorough dislodgement of the hardened material 14 from the rotating buffing pad to thereby quickly return it to a cleansed, usable condition.

The foregoing detailed description is to be clearly understood as being given by way of illustration and example only, the spirit and scope of the present invention being limited solely by the appended claims.

What is claimed is:

1. A tool for mechanically cleaning a rotary buffing pad or the like, comprising:

an air blow gun having;

a hollow handle portion with an air inlet fitting thereon for flowing pressurized air from a source thereof into said handle portion, a hollow barrel portion extending from an upper end portion of said handle portion at an angle relative thereto and having an internally threaded open discharge end for discharging pressurized air from within said barrel portion, and a trigger portion operative to selectively initiate and terminate pressurized air flow from the interior of said handle portion into the interior of said barrel portion;

a support yoke member having;

a base portion having opposite ends, and an inner side surface facing in a first direction, a pair of parallel yoke arms projecting outwardly in said first direction from said opposite base portion ends, said yoke arms having outer ends, an externally threaded cylindrical boss portion extending outwardly from a central portion of said base portion in a second direction opposite from said first direction, said boss portion having an outer end surface and being threaded into said discharge end of said barrel portion of said air blow gun, and an opening extending from said inner side surface of said base portion to said outer end surface of said boss portions;

a coaxially disposed, mutually spaced plurality of generally circular, peripherally toothed cleaning spur members positioned and secured between said outer ends of said yoke arms for rotation relative to said support yoke member about an axis perpendicular to said yoke arms, said spaced plurality of cleaning spur members collectively having a radially outer peripheral portion spaced transversely outwardly from said yoke arms; and an open-ended air discharge flow tube having an inner end portion captively retained in said opening, and a discharge end positioned adjacent and generally directed toward said radially outer peripheral portion of said spaced plurality of cleaning spur members.

2. A portable, hand operable cleaning tool for mechanically dislodging and removing an adhered, potentially abrasive material, such as a hardened rubbing compound material or the like, from the operative side of a previously used rotary buffing pad, during driven rotation of the pad about an axis, to clean the pad and ready it for a subsequent use, said cleaning tool comprising:

a body portion adapted to be grasped and moved by an operator, said body portion being an air blow gun having a hollow handle portion with an air inlet fitting thereon for flowing pressurized air from a supply source thereof into the interior of said handle portion, a hollow barrel portion extending forwardly from an upper end of said handle portion at an angle relative thereto and having a forward discharge end adapted to discharge pressurized air from within said barrel portion, and a trigger portion operative to selectively initiate and terminate pressurized air flow from the interior of said handle portion into the interior of said barrel portion;

a first generally circular cleaning member having a circumferentially spaced series of radially outwardly extending projections on its periphery, said first cleaning member being externally supported on said body portion for movement therewith and rotation relative thereto, and being adapted to be pressed against the operative side of the rotating, previously use buffing pad and laterally moved generally radially inwardly and outwardly therealong to thereby cause said first cleaning member to be rotated by and circumferentially rake the rotating pad and dislodge therefrom hardened material adhered thereto, said first cleaning member being positioned generally forwardly of said discharge end of said barrel portion and being rotatable about a second axis generally perpendicular to each of said handle and barrel portions, said first cleaning member being engageable with the operative side of the rotating pad along a lower circumferential portion of said first cleaning member; and means, carried by said discharge end of said barrel member, for directing pressurized air discharged from said barrel portion generally toward said lower circumferential portion of said first cleaning member and forcibly onto the rotating pad, generally at the area thereon being circumferentially raked by said first cleaning member, to thereby augment the hardened material dislodgement action of said first cleaning member.

3. The cleaning tool of claim 2 further comprising:

a second cleaning member supported on said body portion and having a configuration similar to that of said first cleaning member, said second cleaning member being rotatable about said second axis and spaced apart from said first cleaning member along said second axis.

4. The cleaning tool of claim 3 wherein:

said means are operative to direct pressurized air being discharged from said discharge end of said barrel portion generally toward lower circumferential portions of said first and second cleaning members at an axially intermediate location therebetween.

5. A portable, hand operable cleaning tool for mechanically dislodging and removing an adhered, potentially abrasive material, such as a hardened rubbing compound material or the like, from the operative side of a previously used rotary buffing pad, during driving rotation of the pad about an axis, to clean the pad and ready it for a subsequent use, said cleaning tool comprising:

a body portion adapted to be grasped and moved by an operator;

a first generally circular cleaning member having a circumferentially spaced series of radially outwardly extending projections on its periphery, said first cleaning member being externally supported on said body portion for movement therewith and rotation relative thereto, and being adapted to be pressed against the operative side of the rotating, previously used buffing pad and laterally moved generally radially inwardly and outwardly therealong to thereby cause said first cleaning member to be rotated by and circumferentially rake the rotating pad and dislodge therefrom the hardened material adhered thereto; and means, associated with said body portion for movement therewith, for receiving pressurized air from a source thereof and discharging the received air in a manner causing it to forcibly impinge upon the rotating pad, generally at the area thereon being circumferentially raked by said first cleaning member, to thereby augment the hardened material dislodgement action of said first cleaning member, said body portion being an elongated tube having a first end with an air inlet fitting connected thereto for flowing pressurized air from a source thereof into the interior of said tube, and a closed second end portion, said first cleaning member being coaxially and externally mounted on said second end portion of said tube, and said means including passage means positioned adjacent said first cleaning member, for flowing pressurized air outwardly from said tube generally radially with respect to said first cleaning member.

6. further comprising:

a second cleaning member coaxially and rotatably mounted on said second end portion of said tube in an axially spaced relationship with said first cleaning member, said second cleaning member having a configuration similar to that of said first cleaning member.

7. The cleaning tool of claim 6 wherein:

said passage means are positioned between said first and second cleaning members.

* * * * *